US006663339B1

(12) United States Patent
Woodruff

(10) Patent No.: US 6,663,339 B1
(45) Date of Patent: Dec. 16, 2003

(54) BUCKET SHOE

(76) Inventor: Daniel R. Woodruff, P.O. Box 2620, Ramona, CA (US) 92065

( * ) Notice: Subject to any disclaimer, the term of this patent is extended or adjusted under 35 U.S.C. 154(b) by 0 days.

(21) Appl. No.: 09/884,008

(22) Filed: Jun. 18, 2001

(51) Int. Cl.[7] ..... B66C 23/00

(52) U.S. Cl. ..... 414/722; 414/723; 414/607; 414/912; 37/403; 37/903

(58) Field of Search ..... 414/722, 723, 414/607, 724, 912; 108/51.11; 37/403, 903

(56) References Cited

U.S. PATENT DOCUMENTS 3,115,261 A * 12/1963 Antolini ..... 214/620
4,208,814 A * 6/1980 Stone ..... 37/117.5
4,284,013 A * 8/1981 Davidson ..... 108/50
4,422,819 A * 12/1983 Guest ..... 414/724
4,545,721 A * 10/1985 Pettersson ..... 414/724
6,149,373 A * 11/2000 Gesuale ..... 414/607

* cited by examiner

*Primary Examiner*—Eileen D. Lillis
*Assistant Examiner*—Michael Lowe
(74) *Attorney, Agent, or Firm*—Joseph N. Breaux

(57) ABSTRACT

A bucket shoe system for transporting smaller loader buckets within the loader bucket of a backhoe that includes a frame for holding the smaller buckets that is securable to the loader bucket using D-rings and which is provided with a number of slots for receiving the forks of a fork lift.

1 Claim, 2 Drawing Sheets

BUCKET SHOE

TECHNICAL FIELD

The present invention relates to construction equipment and more particularly to a bucket shoe that is used to safely transport buckets of a backhoe that includes a square steel frame sized and shaped to be positioned inside of a backhoe loader bucket with two to five smaller buckets resting inside the frame; the frame being attachable to the loader bucket with D-rings provided on the side thereof; one side of the frame being provided with slots therein for receiving the forks of a forklift; a cover being provided to allow for a more secure containment for the smaller buckets.

BACKGROUND OF INVENTION

It is often difficult to safely transport a backhoe with a number of loader buckets. It would be a benefit to individuals having to transport these items to have a bucket shoe that could be used to carry the smaller buckets which was securable to the larger backhoe loader bucket so that the smaller buckets could be safely secured. To assist in loading and unloading the frame holding the smaller buckets it would be a benefit if the frame included slots for receiving the forks of a forklift truck.

SUMMARY OF INVENTION

It is thus an object of the invention to provide a bucket shoe that includes square steel frame sized and shaped to be positioned inside of a backhoe loader bucket with two to five smaller buckets resting inside the frame; the frame being attachable to the loader bucket with D-rings provided on the side thereof; one side of the frame being provided with slots therein for receiving the forks of a forklift; a cover being provided to allow for a more secure containment for the smaller buckets.

Accordingly, a bucket shoe is provided. The bucket shoe includes a square steel frame sized and shaped to be positioned inside of a backhoe loader bucket with two to five smaller buckets resting inside the frame; the frame being attachable to the loader bucket with D-rings provided on the side thereof; one side of the frame being provided with slots therein for receiving the forks of a forklift; a cover being provided to allow for a more secure containment for the smaller buckets.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Exemplary Embodiments

Figure 1:
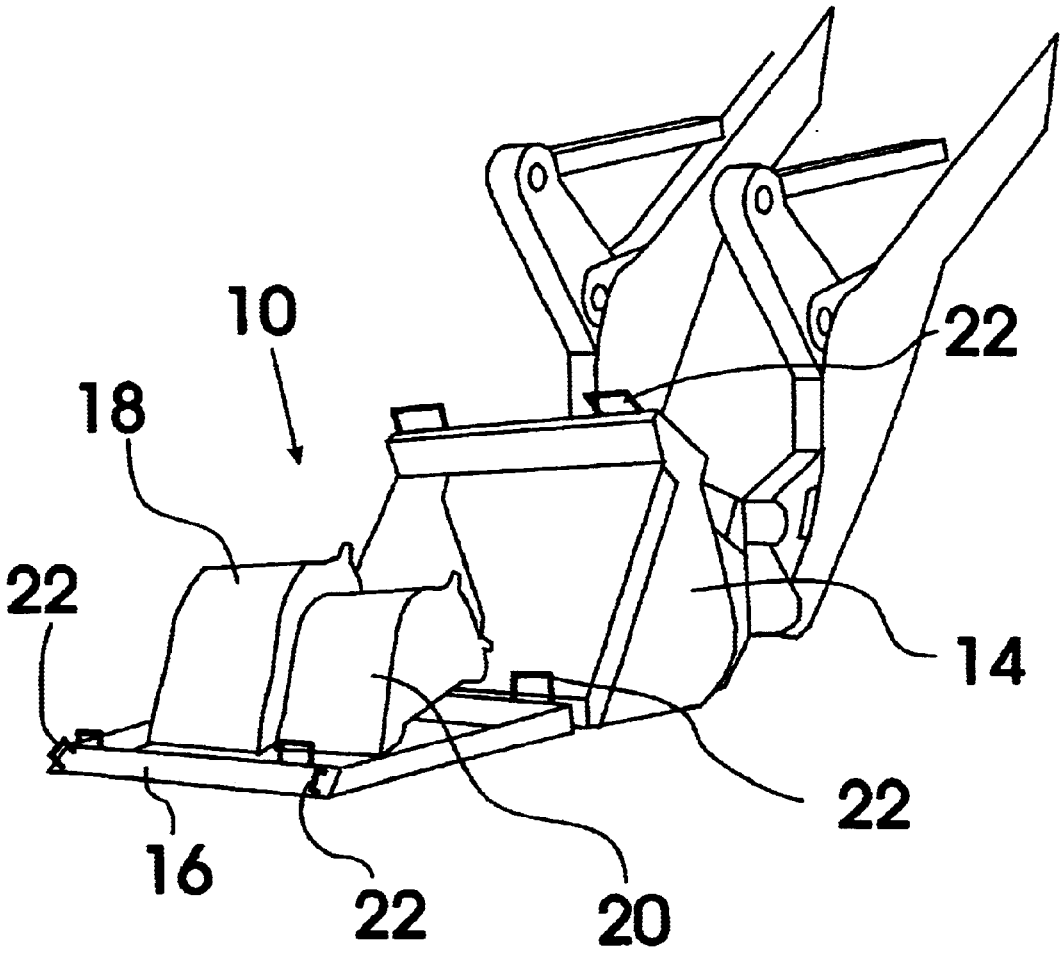
FIG. 1 is a partial perspective view showing an exemplary embodiment of the bucket shoe of the present invention.
Figure 2:
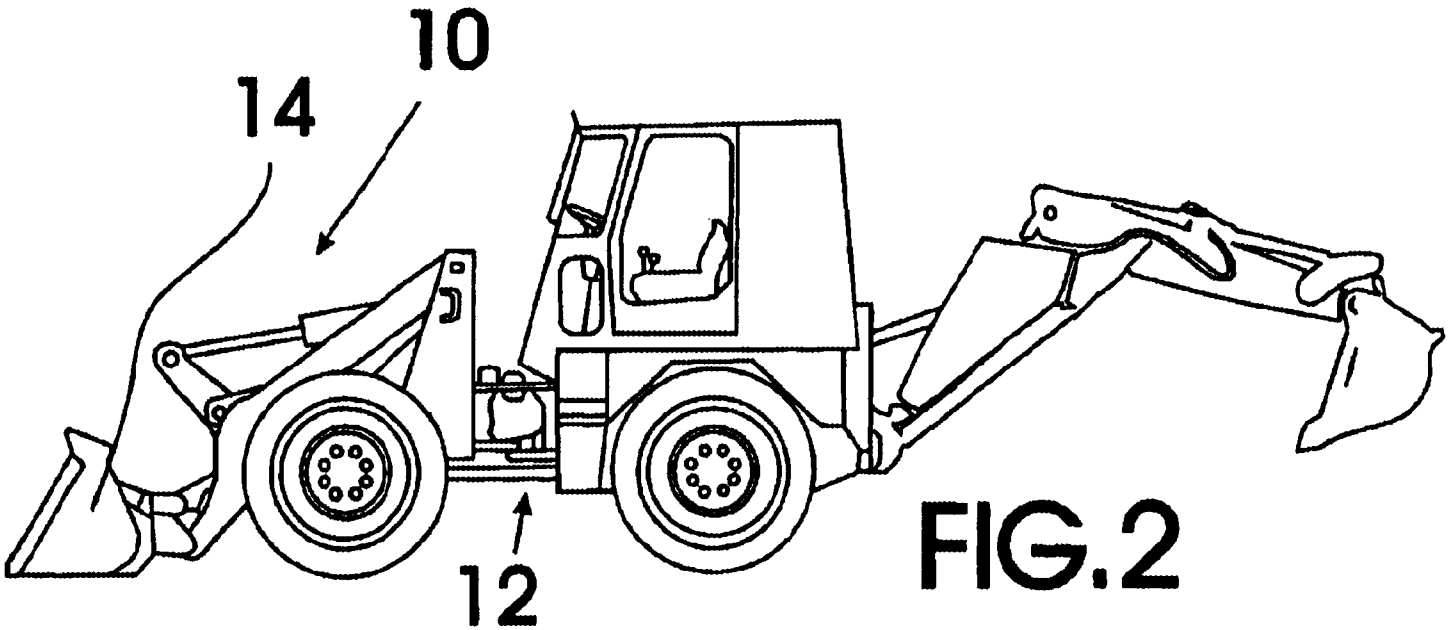
FIG. 2 shows an exemplary embodiment of the bucket shoe connected to a representative backhoe.

FIGS. 1 and 2 show various aspects of an exemplary embodiment of the bucket shoe of the present invention generally designated 10. Bucket shoe 10 is adapted for use with a conventional backhoe 12 having a loader bucket 14 mounted thereon. Bucket shoe 10 includes a frame 16 to which the extra buckets 18, 20 of the backhoe assembly are secured. A number of D-rings 22 are used to secure frame 16 in connection with loader bucket 14.

It can be seen from the preceding description that a bucket shoe has been provided.

It is noted that the embodiment of the bucket shoe described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bucket shoe for a backhoe having a backhoe loader bucket having D-rings on side edges thereof and a smaller backhoe bucket attached thereto that may be detached and used as needed; the bucket shoe comprising:

a rigid, square frame sized and shaped to be positioned inside of and in connection with a backhoe loader bucket in a manner to secure the smaller backhoe bucket within the backhoe loader bucket while the backhoe is transported;

the rigid square frame being attachable to the backhoe loader bucket with D-rings provided on the side thereof;

one side of the rigid square frame being provided with slots therein for receiving the forks of a forklift.

* * * * *